US010618097B2

(12) United States Patent
Rostaing et al.

(10) Patent No.: US 10,618,097 B2
(45) Date of Patent: Apr. 14, 2020

(54) METHOD FOR MANUFACTURING BRILLIANT METAL SEALING CAPS

(71) Applicant: CONSTELLIUM NEUF-BRISACH, Biesheim (FR)

(72) Inventors: Nicolas Rostaing, Saint Paul de Varces (FR); Christian Desclos, Seyssins (FR)

(73) Assignee: Constellium Neuf-Brisach, Biesheim (FR)

( * ) Notice: Subject to any disclaimer, the term of this patent is extended or adjusted under 35 U.S.C. 154(b) by 209 days.

(21) Appl. No.: 15/036,556

(22) PCT Filed: Nov. 14, 2014

(86) PCT No.: PCT/FR2014/000243

§ 371 (c)(1),
(2) Date: May 13, 2016

(87) PCT Pub. No.: WO2015/075324

PCT Pub. Date: May 28, 2015

(65) Prior Publication Data

US 2016/0288195 A1 Oct. 6, 2016

(30) Foreign Application Priority Data

Nov. 19, 2013 (FR) ..... 13 02659

(51) Int. Cl.
*B21D 51/44* (2006.01)
*B21D 22/20* (2006.01)
(Continued)

(52) U.S. Cl.
CPC ..... *B21D 51/44* (2013.01); *B21D 22/201* (2013.01); *B21D 28/00* (2013.01); *B21D 51/26* (2013.01); *B65D 41/04* (2013.01)

(58) Field of Classification Search
CPC ..... B21D 51/44; B21D 51/446; B21D 51/48; B21D 51/50
See application file for complete search history.

(56) References Cited

U.S. PATENT DOCUMENTS 4,040,282 A * 8/1977 Saunders ..... B21D 22/30 72/349
4,923,548 A * 5/1990 Granger ..... B65D 41/62 156/182
(Continued)

FOREIGN PATENT DOCUMENTS

EP 0469774 A1 2/1992
EP 0572016 A1 12/1993
(Continued)

OTHER PUBLICATIONS

International Search Report from corresponding PCT/FR2014/00243, dated Jan. 19, 2015.

*Primary Examiner* — Debra M Sullivan
(74) *Attorney, Agent, or Firm* — McBee Moore & Vanik IP, LLC

(57) ABSTRACT

A method for manufacturing metal sealing caps comprising providing a strip or sheet of aluminum alloy of the grade known to a person skilled in the art as "brilliant" or "grand brilliant", typically being coated on at least one of the two surfaces thereof, generally the surface intended for the inside of the cap, with a layer of stamping varnish is described herein.

17 Claims, 3 Drawing Sheets

(51) Int. Cl.

| | |
|---|---|
| ***B21D 51/26*** | (2006.01) |
| ***B65D 41/04*** | (2006.01) |
| ***B21D 28/00*** | (2006.01) |

(56) References Cited

U.S. PATENT DOCUMENTS

| | | | | |
|---|---|---|---|---|
| 5,644,841 | A * | 7/1997 | Stewart ..... | B21D 53/085<br>29/890.03 |
| 6,403,173 | B1 | 6/2002 | Granger et al. | |

FOREIGN PATENT DOCUMENTS

| | | | |
|---|---|---|---|
| EP | 1304217 | B1 | 4/2003 |
| EP | 1359006 | A1 | 11/2003 |
| GB | 2286364 | A | 8/1995 |
| JP | H09268505 | A | 10/1997 |
| JP | 2006272424 | A | 10/2006 |
| JP | 2008230678 | A | 10/2008 |
| JP | 2013100126 | A | 5/2013 |
| WO | 9206804 | A1 | 4/1992 |

* cited by examiner

METHOD FOR MANUFACTURING BRILLIANT METAL SEALING CAPS

CROSS REFERENCE TO RELATED APPLICATIONS

This application is a § 371 National Stage Application of PCT/FR2014/000243, filed Nov. 14, 2014, which claims priority to FR 1302659, filed Nov. 19, 2013.

BACKGROUND

Field of the Invention

The invention relates to the field of sealing caps comprising an outer metal shell made of aluminum alloy and in particular screw caps that comprise an inner insert typically made of plastic material and threaded. These caps are intended for capping containers, substantially glass bottles that contain alcoholic beverages and in particular wine or spirits.

The invention relates more particularly to a method for manufacturing these caps that makes it possible to obtain a substantially uniform brilliance on the top, or head, and on the "vertical" wall or skirt of the outside of the cap.

Description of Related Art

Sealing caps made of aluminum alloy are typically manufactured in the following way:

- A stamping press forms preforms of caps from a strip or sheet also called a format, cut into blanks, varnished on both of their surfaces, of a typical thickness ranging from 0.15 to 0.25 mm without taking the varnish into account. According to the height of the skirt (length of the cap preform), one to three stamping passes may be required.

The brilliant appearance of the cap is substantially given by the quality of the varnish. In certain applications, rather of high end, the brilliant appearance can be obtained on the final cap by a method of metallization of which the speeds are generally low.

- These preforms are degreased in an oven at a high temperature, typically from 180 to 210° C., for a period of time ranging from 3 to 5 minutes, in order to remove the stamping lubricant.
- They are then lacquered over their entire external surface and are placed in an over in order to cure the lacquer.
- These lacquered preforms are printed on the skirt, typically via silk screening, method known to a person skilled in the art as "Offset", with a final drying of the inks in an oven.
- An overprinting varnish is finally applied in order to protect the printing, said varnish being dried during a passage in the oven.
- The preform obtained as such is provided with a seal and/or a threaded interior plastic insert.

Note that all of the aluminum alloys that are concerned in what follows are designated, unless mentioned otherwise, according to the designations defined by the "Aluminum Association" in the "Registration Record Series" that it publishes on a regular basis.

Problem Posed

The growing interest for aesthetic solutions led the applicant to test the use of strips of aluminum alloy of the grade known to a person skilled in the art as "brilliant" or "grand brilliant", i.e. having a roughness Ra, measured according to the standard NF EN ISO 4287, typically less than 0.15 μm, and even 0.015 μm in the case of "grand brilliant", for the stamping of the preforms of caps.

However, after the stamping, the quality of the brilliant appearance remains substantially unchanged on the head of the preform, but is highly degraded on the skirt which has a more or less matte appearance.

This problem is well known in particular in patent EP 1304217 B1 of "Italcoat", of which the priority application in 2001, which describes it in paragraph [0005] and proposes a relatively complex method for resolving it.

Industrially known solutions are of two types:

- Stamping of metal coated with varnish also on the surface corresponding to the outside of the cap preform; it is then the brilliance of the varnish that confers the final brilliance, in general of average quality, even if the base metal is brilliant, due to the fact that the appearance that has become matte of the skirt is visible through transparency.
- Metallization on the outside of the preform of the final cap, method generally implemented for caps made of plastic and requiring exceptional brilliance, but this method is slow and expensive and because of this is limited to the field of cosmetics packaging.

The invention aims to overcome this problem by proposing a method that retains the initial brilliant appearance over the entire surface of the preform, head and skirt, in conditions that are industrially economical for the market of sealing caps for beverage bottles.

SUMMARY

The invention relates to a method for manufacturing metal sealing caps comprising:

a) providing a strip or sheet of aluminum alloy of the grade known to a person skilled in the art as "brilliant" or "grand brilliant", i.e. having a roughness Ra, measured according to the standard NF EN ISO 4287, less than 0.15 μm, typically being coated on at least one of the two surfaces thereof, generally the surface intended for the inside of the cap, with a layer of stamping varnish, i.e. that does not undergo any deterioration during the stamping, b) a first operation of cutting same into discs referred to as blanks, c) a step of stamping said blank metal, in one or more passes, typically using a stamping lubricant, such as to form a stamped preform, including a head and a skirt, typically axisymmetrical in an axial direction, d) a step of degreasing, thermal, typically at a temperature from 180 to 210° C., for a period of time from 3 to 5 minutes, or chemical in an alkaline medium, of said stamped preform, intended typically for removing the leftover lubricant, in order to form a degreased preform which is capable of being possibly varnished, e) an optional step of applying a protective and/or decorative varnish, and characterized in that it comprises, after, possibly chained directly with the step of stamping, at least one stretching step which consists of passing the stamped preform through at least one stretching ring in order to elongate and thin out the metal.

Typically, the blank has a thickness from 0.15 to 0.25 mm without taking the varnish into account.

According to the most common mode, the rate of stretching (1—final thickness/initial thickness of the sheet or strip) is greater than or equal to 2.5%.

According to a preferred embodiment, it is less than or equal to 30%.

According to a particular embodiment, only the surface intended for the inside of the cap is coated with a varnish before stamping and the surface intended for the outside of the cap is coated only after the step of degreasing.

According to another embodiment, the two surfaces intended for the inside and the outside are coated with a varnish before stamping.

Advantageously, the lubricant used for the stamping is volatile and eliminated via heating.

The same applies for the lubricant used for the stretching which, advantageously, is volatile and eliminated via heating, typically in a tunnel oven or oven.

Moreover, the same lubricant can be used for the two steps of stamping and stretching.

Advantageously, the steps of stamping and stretching are chained into two integrated steps, i.e. without another intermediate step and even more advantageously, they are carried out in a single and same press stroke.

Finally, the aluminum alloy can be, but not exclusively, of the AA3105 type or of the AA8011 type.

The invention also has for object a metal sealing cap manufactured by the method that has one of the preceding characteristics, and characterized in that its roughness index Ra is less than 0.15 μm, i.e. of the "brilliant" or "grand brilliant" type, and substantially uniform on the top, or head, and skirt, or wall unit.

DESCRIPTION OF THE FIGURES

For the cap A, carried out according to prior art using brilliant metal, therefore stamped and not stretched, always measured in the long direction from top to bottom of the wall, marked as LD, or traverse at the top of the wall, marked as TD, For the cap B, repetition of the tests hereinabove, For the cap C, stamped then stretched according to the invention using brilliant metal, For the cap D, repetition of the tests hereinabove.

For the cap A, stamped according to prior art using brilliant metal, on the top of the cap, For the cap B, repetition of the tests hereinabove, For the cap C, stamped then stretched according to the invention using brilliant metal, on the top of the cap, For the cap D, repetition of the tests hereinabove, For the cap E, stamped only according to prior art using a crude non-brilliant rolling metal of the type known to a person skilled in the art as "Mill Finish", (the two points LD and TD are confounded), For the mark F: on starting brilliant flat sheet metal, before stamping, For the mark G: crude flat rolling sheet metal "Mill Finish".

Figure 5:
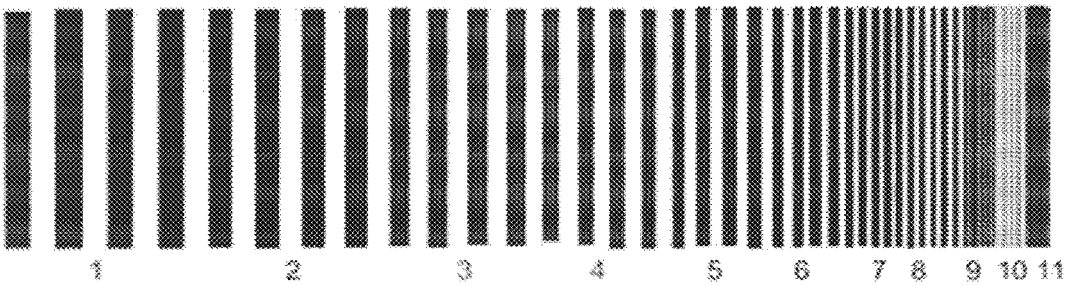

FIG. 5 shows the pattern, on a graduated scale comprised of optical combs, used to quantify the brilliance of the cap walls by applying the standard NF EN ISO 10215 for characterizing image sharpness on anodized products in order to apply it to the characterization of the brilliance.

BRIEF DESCRIPTION OF THE DRAWINGS

FIGS. 1-5 depict embodiments as described herein.

DETAILED DESCRIPTION OF A PREFERRED EMBODIMENT

As mentioned hereinabove, due to an increasing interest in the market for aesthetic but economical sealing caps, i.e. of a cost that is compatible with the requirement of the beverage bottle market and not that of cosmetic products, the applicant had the idea to test the use of strips of aluminum alloy of the grade known to a person skilled in the art as "brilliant" or "grand brilliant", i.e. having a roughness Ra, measured according to the standard NF EN ISO 4287, typically less than 0.15 μm, for the stamping of the preforms of caps.

Unfortunately, the applicant observed that after the stamping, if the quality of the brilliant appearance remained unchanged on the head or top of the preform, it was highly degraded on the skirt which had a more or less matte appearance.

At the same time, the applicant was engaged in a program to reduce the thickness of said sealing caps in order to minimize the quantity of metal implemented. The applicant as such succeeded in carrying out an additional stretching pass after the conventional stamping in one or several passes, with the latter leading to a non-compliant skirt thickness which can therefore be optimized at its minimum.

This type of stretching, also known as "calibration", is not used in the field of sealing caps and is currently used only in that of beverage cans or bottles.

During tests using metal of the "brilliant" quality, the applicant then observed unexpectedly that the brilliance was covered at the end of said step and had, on the wall or skirt of the cap, the level of that of the top, or head of the cap.

The interest of the invention would therefore be multiple: rendering uniform the thickness of the skirt over its entire height by minimizing the quantity of material used, or by authorizing the manufacture of higher caps without increasing the quantity of material, and finally, obtaining a uniform level of brilliance on the top or head and on the cap skirt or wall.

Figure 1:
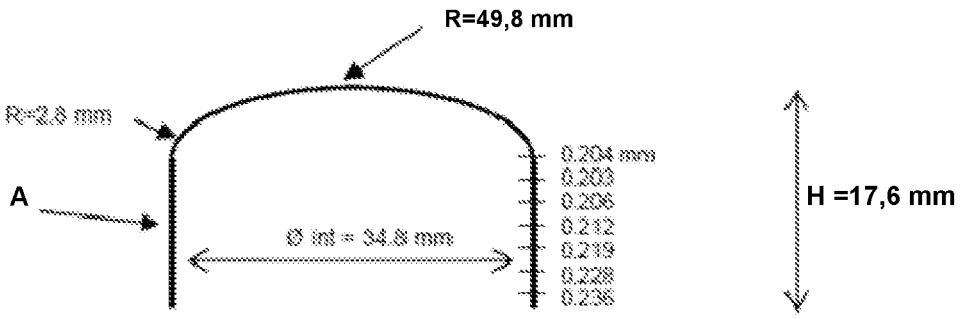
FIG. 1 is a diagrammatical cross-section of the cap used for the tests, after stamping, here in one pass, and before stretching according to the invention. Its height h is 17.6 mm, its top or head has a radius R of 49.8 mm and is connected to the skirt or vertical wall A with a radius R of 2.8 mm FIG. 2 diagrammatically shows the embodiment of the roughness measurements according to the standard NF EN ISO 4287 according to the long direction on the left, here for a stamped cap, and on the right according to the traverse direction, here for a stamped and stretched cap according to the invention.

The minimum stretching rate is justified by the fact that the latter must at least bring the thickness of the entire skirt substantially uniformly to the value of the minimum thickness locally obtained after stamping (or 0.203 mm in the case of FIG. 1). The latter depends on the stamping conditions (roughness of the tool, play, pressure of the blank-holding, lubrication). It is generally considered that this minimum rate is 2.5 and even 3%.

The maximum stretching rate is linked to the stretchability limit before rupture, intrinsic to the alloy, which must not be exceeded during the stretching, or calibration, of the bottom of the skirt, the thickest zone (0.236 mm according to FIG. 1). Its "$play_{max}$" value is given by the formula $(1-play_{max})/(1-LIR)=e_{max}/e_{init}$) where LIR is the limit of stretchability of the metal, $e_{max}$ is the maximum thickness of the skirt bottom (0.236 mm according to FIG. 1) and $e_{init}$ the initial thickness of the sheet (0.210 mm in the case corresponding to FIG. 1).

In the case of an alloy of the AA3104 or 3105 type, the limit of industrially permissible stretchability limit is 40%. A maximum stretching rate of substantially 30% is then obtained.

In its details, the invention will be better understood using the example hereinafter, which however do not have any limiting nature.

Examples of Embodiments

Step of Stamping

Strips of metal made of an alloy of the type AA3105 of the grade known to a person skilled in the art as "brilliant", of a roughness Ra of 0.08 μm, a thickness of 0.210 mm (without varnish), were cut into the format 870×280 mm.

The formats were cut into stamping blanks of a diameter of 58.70 mm using a blanking punch.

The first stamping pass was carried out on these non-varnished blanks with tools of the following characteristics:

Diameter of the punch: 34.80 mm; radius of the punch: 2.80 mm, i.e. a stamping Re=Ø blank/Ø punch ratio of 1.69.

The diameter of the die was 35.30 mm and its radius was 1.10 mm.

The roughness of the surface of the die in contact with the metal was Ra=0.2.

The lubricant was of the type known under the reference LAPPING OIL 67 from HENKEL.

It was installed using an automatic device commonly used in cap manufacturing plants.

The pressure of the blank-holding was adjusted in such a way as to obtain a cup without folds.

This step made it possible to manufacture stamped cups or caps referenced as A and B such as diagrammatically shown in a cross-section in FIG. 1.

It is noted that, in particular, when the initial thickness of the metal is 0.210 mm, the minimum on said cups has changed to 0.203 mm while the maximum is at 0.236 mm. This type of thickness profile is in fact characteristic of a cup obtained by stamping.

Step of Stretching

The second pass, of stretching, was carried out on the previously stamped cups according to the step 1 hereinabove, with tools of the following characteristics:

Diameter of the punch: 34.8 mm

Diameter of the stretching ring at 10%: 35.178 mm

The diameter of the stretching rings corresponds to a negative play with respect to the initial thickness (here metal thickness=0.210 mm) of metal between the diameters of the punch and of the die and is calculated in the following way:

$$Ø\ \text{Stretching ring} = Ø\ \text{Punch} + (2 \times \text{metal thickness} \times (1 - \text{play}\ \%))$$

play % being the rate of stretching, here 10%, i.e. 0.1

In fact, it has been seen, in the step 1, that the thickness obtained in the skirt was not constant:

As such, for the minimum thickness of 0.203 mm, the actual stretching is in fact 7%, For the maximum thickness of 0.236 mm, the actual stretching is in fact 20%.

More generally the minimum stretching is imposed by the minimum thickness of the skirt after stamping. In this case, for a minimum thickness of 0.203 mm, the minimum stretching in order to obtain a brilliance covering the entire height of the skirt is 3.3%. This value, corresponding to the stretching required to obtain the minimum thickness of the skirt after stamping of 0.203 mm over its entire height, is obtained by the aforementioned formula (1—final thickness/initial thickness) where final thickness is 0.203 mm and the initial thickness 0.210 mm.

Several lubricants from among the most commonly marketed were tested with success, of which tallow, the lubricants "KLÖBERFOOD NH1 16-180" and "PARALIQ P12" from "KLÖBER Lubrication".

Figure 3:
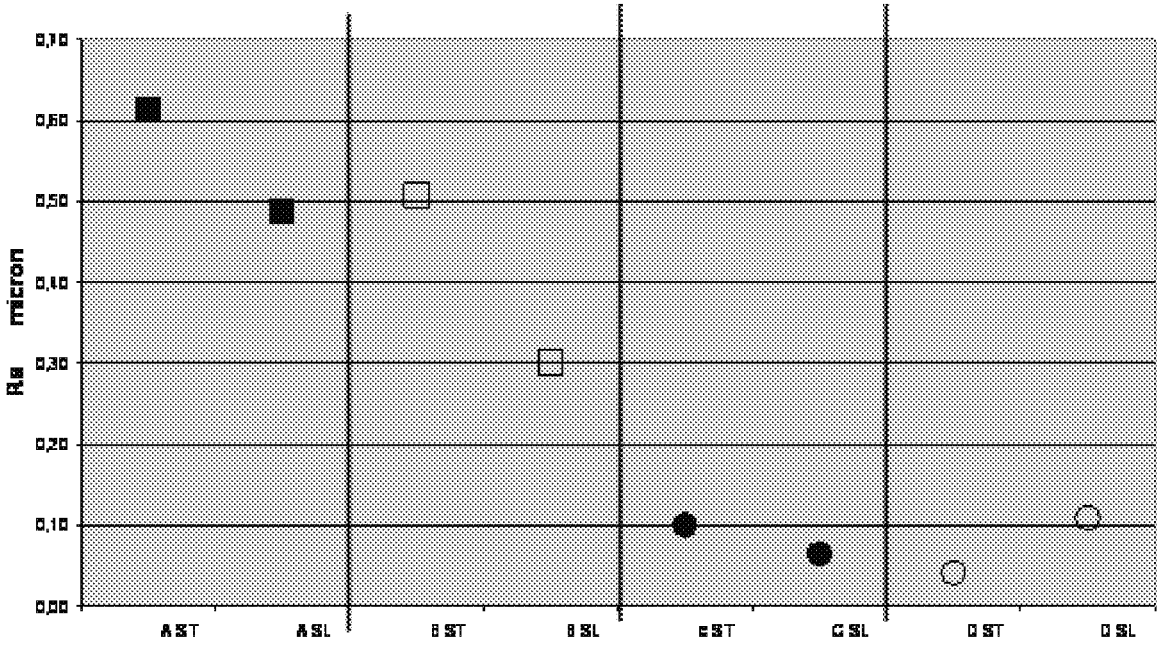
FIG. 3 shows the roughness Ra in microns obtained for the cap preform walls or skirts, measured in the long direction from top to bottom of the wall, marked as LD, or traverse at the top of the wall, marked as TD.
Figure 4:
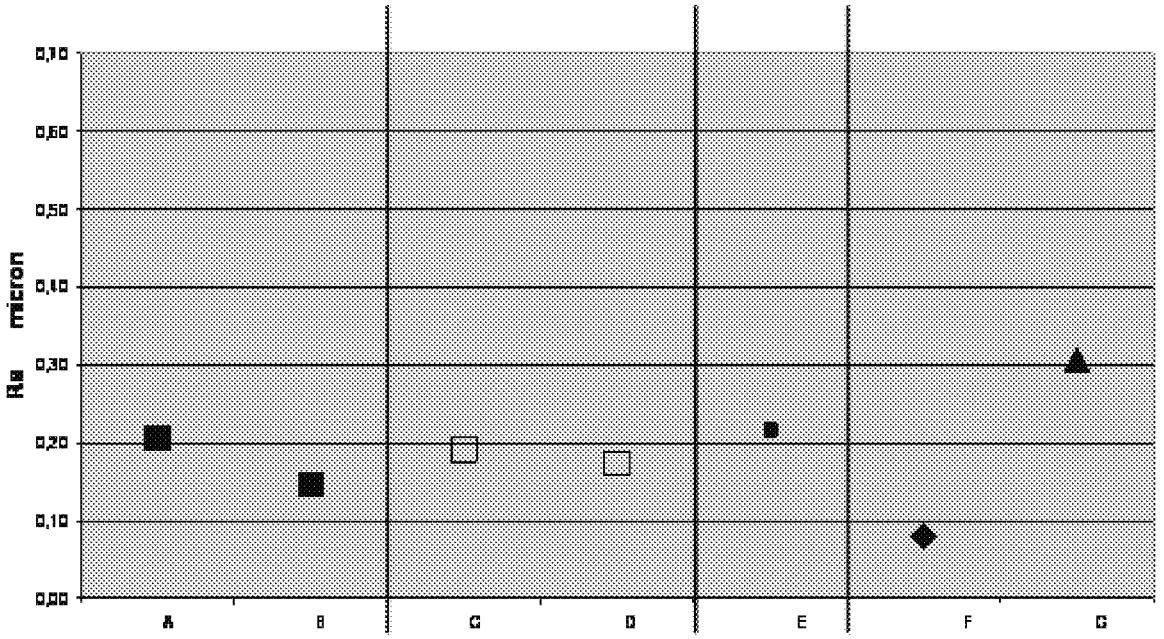
FIG. 4 shows in the same way the roughness obtained.

This step made it possible to manufacture stamped stretched caps in accordance with the invention, referenced as C and D in FIGS. 3 and 4.

Results of the Tests:

To quantify the criterion which is the brilliance, two parameters were used:

The surface roughness, with the latter being all the more so brilliant as the surface is smooth therefore low roughness, The sharpness of an image reflected by the surface using as a basis the standard NF EN ISO 10215 concerning the characterization of the sharpness of the image on anodized products.

Surface Roughness Ra

The roughness of the cap, stamped and stretched according to the invention, was compared with the roughness of the cap stamped only (according to prior art), and finally with the initial roughness of the metal in strips or sheets or starting format flat, before forming the cap.

Figure 2:
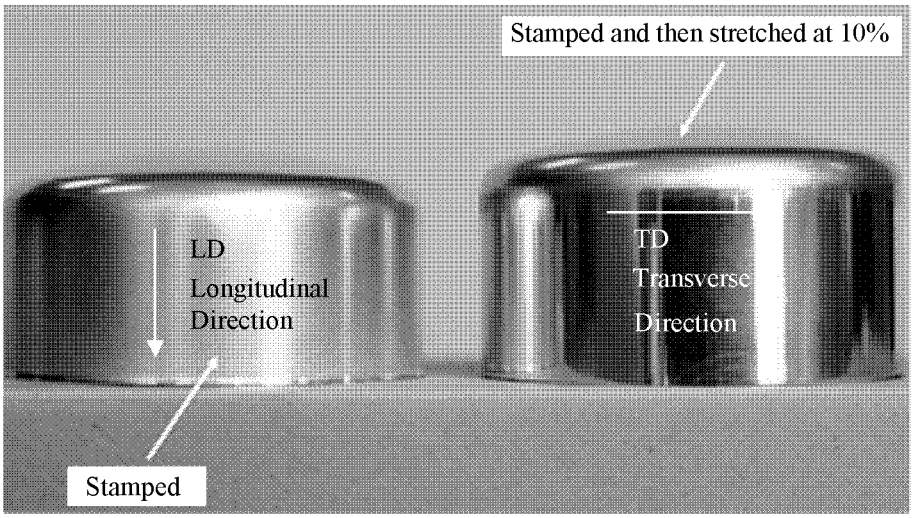

On the cap itself, the roughness was measured on the wall or skirt and on the top, i.e. at the substantially flat portion, in the long direction (LD), from top to bottom of the wall, and in the traverse direction (TD) at the top of the wall, as indicated in FIG. 2.

On the flat metal, the roughness was measured in the rolling direction (LD) and in the traverse direction (TD).

The following codes will be used:

A: cap stamped according to prior art using brilliant metal,

B: repetition of the tests hereinabove,

C: capsule stamped then stretched according to the invention using brilliant metal, D: repetition of the tests hereinabove, E: cap stamped only, according to prior art, using crude non-brilliant rolling metal of the type known to a person skilled in the art under the name "Mill Finish", (the two points LD and TD are confounded)

F: starting brilliant flat sheet metal, before stamping

G: crude flat rolling sheet metal known under the name "Mill Finish".

FIG. 3 compares the roughnesses of the walls or skirts of the caps A and B of prior art with those of the caps C and D according to the invention.

It clearly shows that the invention makes it possible to divide by a factor of three to six the roughness of the wall, and this regardless of the direction of measurement (LD or TD).

In addition, the roughnesses of the skirts of the caps according to the invention are very similar in the long direction and in the traverse direction, which is obviously of considerable importance due to its impact of the homogeneity of the brilliance over the entire skirt or wall, FIG. 4 compares the roughnesses on the top of the caps A, B, C and D as well as on the cap E stamped only, according to prior art, using non-brilliant crude "Mill Finish" metal, and on the starting strips or sheets before stamping F, brilliant sheet, and G, crude rolling "Mill Finish" sheet.

It clearly shows, by comparison between the caps (A, B) and (C, D), that, on the top of the cap, the roughness is unchanged, i.e. the invention does not modify the brilliance of the top of the cap. It is greater than the initial roughness of the brilliant metal, but remains less than the roughness of a crude rolling "Mill Finish" metal. This point demonstrates the interest in using, as a starting sheet, a brilliant metal in order to draw the best from the initial brilliance on the top of the cap and obtain, through stretching, an improved brilliance globally, including the skirt or wall.

These results are moreover identical for all of the usual criteria for 2D or 3D measuring roughness (Rz, or Sk for example).

Sharpness of the Reflected Image:

The method of the standard NF EN ISO 10215 for characterizing image sharpness on anodized products has been implemented here in order to apply it to the surfaces of skirts according to the invention.

As such the graduated scale was used, comprised of optical combs, such as shown in FIG. 5, and the rating, or scale of sharpness, allowing for a classification of the sharpness of the image, such as in table 1 hereinbelow:

TABLE 1

| Class | 1 | 2 | 3 | 4 | 5 | 6 | 7 | 8 | 9 | 10 | 11 |
|---|---|---|---|---|---|---|---|---|---|---|---|
| Width (mm) | 2.0 | 1.75 | 1.5 | 1.25 | 1.0 | 0.75 | 0.5 | 0.375 | 0.25 | 0.188 | 0.125 |

The test consists in placing the cap, skirt or wall, at a distance d from the pattern of optical combs and in evaluating the class beyond which the streaks of the pattern are no longer visible or, more precisely, can no longer be visually dissociated.

The results obtained for caps A and B according to prior art as well as for C and D, according to the invention, are indicated in table 2 hereinafter:

TABLE 2

| Distance d | Capsules A and B (prior art) | Capsules C and D (according to the invention) |
|---|---|---|
| 0 mm | 9 | >11 |
| 5 mm | 8 | >11 |
| 10 mm | 6 | 10 |

These results, by comparison between the caps A and B of prior art and the caps C and D, according to the invention, show a very substantial improvement in the sharpness, therefore of the corresponding brilliance on the skirts of said caps.

The invention claimed is:

1. Method for manufacturing a metal sealing cap comprising:

a) providing a strip or sheet of aluminum alloy of the grade brilliant or grand brilliant, optionally with a layer of stamping varnish on at least one of two surfaces thereof, b) a first operation of cutting the strip or sheet of aluminum alloy into discs referred to as blanks, c) applying stamping lubricant to said blanks, d) stamping said blanks, in one or more passes, to form a stamped preform, including a head and a skirt, (e) removing leftover stamping lubricant by degreasing said stamped preform, to form a degreased preform, and further wherein, after the stamping, f) conducting at least one stretching step which consists of passing the stamped preform through at least one stretching ring in order to elongate and thin out the metal to form a sealing cap.

2. Method according to claim 1 wherein a rate of stretching, which corresponds to formula, 1- final thickness/initial thickness, is greater than or equal to 2.5%.

3. Method according to claim 2, wherein the strip or sheet of aluminum alloy is coated on at least one of two surfaces thereof with the layer of stamping varnish before the cutting and stamping.

4. Method according to claim 3 wherein, the blanks have a thickness of 0.15 to 0.25 mm without taking into account the thickness of the varnish.

5. Method according to claim 4, wherein stamping and stretching are chained into two integrated steps.

6. Method according to claim 1 wherein a rate of stretching is less than or equal to 30%.

7. Method according to claim 1 wherein stamping and stretching are chained without another intermediate step.

8. Method according to claim 1 wherein stamping and stretching are carried out in a single and same press stroke.

9. Method according to claim 1 wherein the aluminum alloy is of the AA3105 type.

10. Method according to claim 1 wherein the aluminum alloy is of the AA8011 type.

11. Method according to claim 1, wherein the stamped preform is axisymmetrical in an axial direction of the stamped preform.

12. Method according to claim 1, wherein after the degreasing, a protective and/or decorative varnish is applied to the degreased preform.

13. Method according to claim 1, wherein the strip or sheet of aluminum alloy has a roughness Ra of less than 0.15 μm.

14. Method according to claim 1, wherein the strip or sheet of aluminum alloy is coated on at least one of two surfaces thereof with the layer of stamping varnish before the cutting and stamping.

15. Method according to claim 14 wherein the blanks have a thickness of 0.15 to 0.25 mm without taking into account the thickness of the varnish.

16. Method according to claim 14, wherein only the surface intended for the inside of the cap is coated with the varnish before stamping, and the surface intended for the outside of the cap is coated only after degreasing.

17. Method according to claim 14, wherein the two surfaces intended for the inside and the outside of the cap are both coated with the varnish before stamping.

* * * * *